US006419599B1

(12) United States Patent
Kite

(10) Patent No.: US 6,419,599 B1
(45) Date of Patent: Jul. 16, 2002

(54) METHOD AND MEANS FOR LOCATING PERIMETER POINTS FOR LINES ON ATHLETIC FIELDS

(75) Inventor: John H. Kite, Urbandale, IA (US)

(73) Assignee: True Pitch, Inc., Altoona, IA (US)

( * ) Notice: Subject to any disclaimer, the term of this patent is extended or adjusted under 35 U.S.C. 154(b) by 411 days.

(21) Appl. No.: 08/987,487

(22) Filed: Dec. 9, 1997

(51) Int. Cl.[7] ..... A63C 19/06
(52) U.S. Cl. ..... 473/490
(58) Field of Search ..... 473/490; 273/FOR 212

(56) References Cited

U.S. PATENT DOCUMENTS

| | | | | |
|---|---|---|---|---|
| 391,660 A | * | 10/1888 | Thayer | 473/490 X |
| 1,263,198 A | * | 4/1918 | Brandt | 473/490 |
| 2,468,211 A | * | 4/1949 | Kuoska | 473/490 X |

* cited by examiner

*Primary Examiner*—Paul T. Sewell
*Assistant Examiner*—M. Chambers

(57) ABSTRACT

A method of identifying perimeter markings for lines on athletic fields involves locating two or more perimeter points on a line of an earthen athletic field comprising a ground surface; drilling a vertical hole in the earth in said points; placing a flexible elongated marking rope with a ground anchor on one end thereof longitudinally into each of the holes so that the ground anchor is in the lower end of the hole, and so that the upper portion of the rope extends from the hole above the ground surface. Loose material, such as loose dirt, is packed into the hole around the rope whereupon the upper portions of the ropes above the ground surface will serve as visible indicators of the location of the points. The rope is a plastic rope of polyethylene or the like which is six to eight inches long. It has a ground anchor on one end. The ground anchor is positioned in the lower end of the hole drilled in the earthen surface and serves to anchor the rope in the hole when loose dirt or the like is packed into the hole around the upwardly extending rope.

5 Claims, 3 Drawing Sheets

METHOD AND MEANS FOR LOCATING PERIMETER POINTS FOR LINES ON ATHLETIC FIELDS

BACKGROUND OF THE INVENTION

It is well known that lines must be created on many types of athletic fields. This would include yard lines and hash marks on football fields, boundary lines on soccer fields, foul lines, batters' boxes, coaching boxes, and the like on baseball fields, and many others. These lines are created by special line marking devices which deposit a layer of lime or the like as the device is moved along the predetermined path of the line to be made. Sometimes a taut line is stretched between perimeter points relating to the line to be made, and the line marking device is pushed along the taut string to insure that the marking material is accurately deposited on the desired path of the line to be made.

Some attempts have been made to identify these perimeter points by driving pegs or the like at the perimeter points and stretching a string therebetween to serve as a guide for making the desired line. This process has certain shortcomings including the fact that the pegs often get covered with dirt or other debris and cannot be easily found. Sometimes the pegs present a possible source of injury to players to the extent that they may protrude upwardly from the ground surface.

It is therefore a principal object of this invention to provide a method and means for locating perimeter points for lines on athletic fields wherein the perimeter points can be easily marked with a permanent identifier which is always fully visible, safe for the persons using the athletic field, and very permanent in nature.

These and other objects will be apparent to those skilled in the art.

SUMMARY OF THE INVENTION

A method of identifying perimeter markings for lines on athletic fields involves locating two or more perimeter points on a line of an earthen athletic field comprising a ground surface; drilling a vertical hole in the earth in said points; placing a flexible elongated marking rope with a ground anchor on one end thereof longitudinally into each of the holes so that the ground anchor is in the lower end of the hole, and so that the upper portion of the rope extends from the hole above the ground surface. Loose material, such as loose dirt, is packed into the hole around the ropes whereupon the upper portions of the ropes above the ground surface will serve as visible indicators of the location of the points.

The rope is a plastic rope of polyethylene or the like which is six to eight inches long. It has a ground anchor on one end. The ground anchor is positioned in the lower end of the hole drilled in the earthen surface and serves to anchor the rope in the hole when loose dirt or the like is packed into the hole around the upwardly extending rope.

A tool for inserting the elongated rope into the hole has an elongated hollow tube slightly longer than the rope. The tube has upper and lower ends. A stop element is mounted on the outside of the tube adjacent the upper end to limit the downward movement of the tube into the hole. A transverse handle is mounted on the upper end of the tube for facilitating the pushing of the tube into the hole. The rope is positioned within the tube with the anchor on the rope at the lower end of the tube. The upper end of the rope extends above the stop element. The tube of the tool with the rope inserted therein is pushed into the bored hole, and when the anchor is at the desired depth as governed by the stop element, the tool is lifted out of the hole leaving the rope deposited in the hole.

DESCRIPTION OF THE PREFERRED EMBODIMENT

Figure 3:
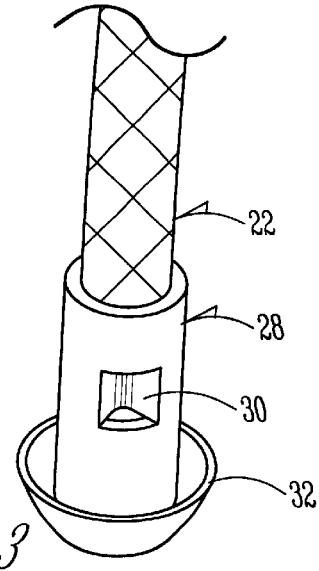
FIG. 3 is a large scale partial perspective view of the lower end of the rope shown in FIG. 2.
Figure 3A:
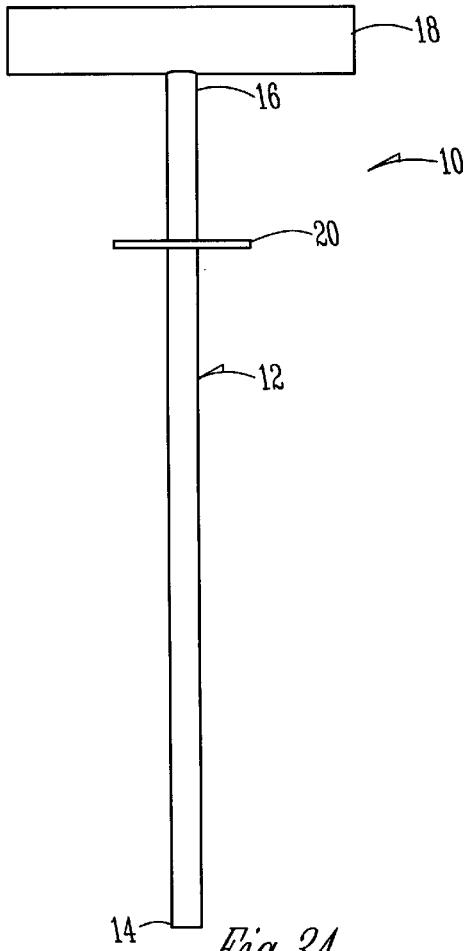
FIG. 3A is a side elevational view of the tool used in this invention.

With reference to FIG. 3A, the insertion tool 10 of this invention is comprised of an elongated tube 12 approximately 6 to 10 inches long and having a diameter of approximately ¼". Tube 12 has a lower end 14 and an upper end 16. A transverse handle 18 extends across the upper end 16 of the tube 12 to facilitate the pushing of the tool into an elongated vertical hole in the ground as will be described hereafter. A circular stop element 20 is horizontally rigidly fixed to the outer surface of the tube slightly spaced from the handle 18 and the upper end 16 of the tube.

Figure 2:
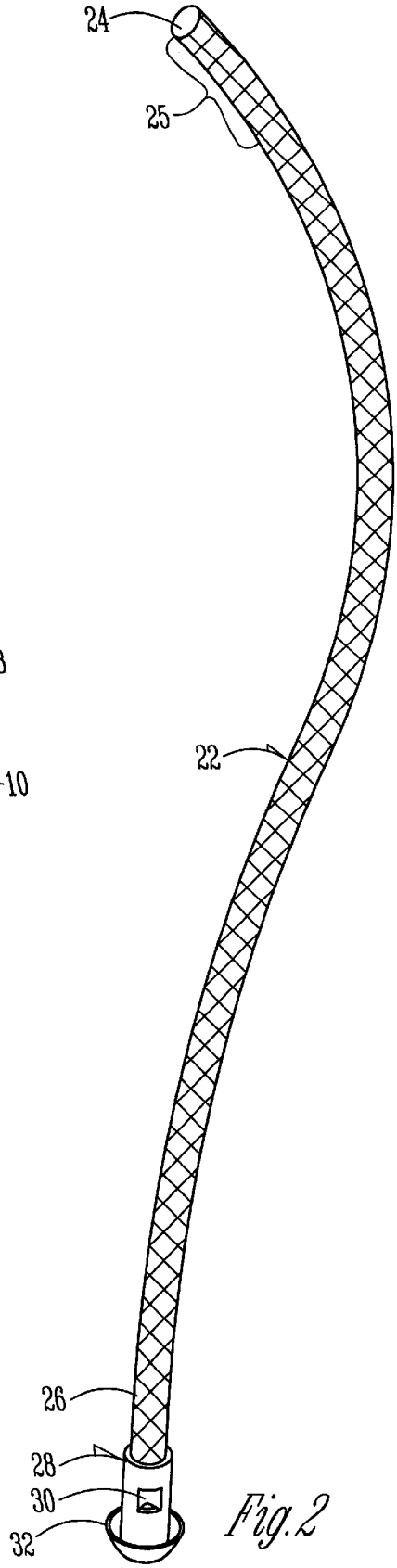
FIG. 2 is an enlarged scale perspective view of the rope marker of this invention.

With reference to FIGS. 2 and 3, the marking rope 22 has a diameter slightly less than the interior diameter of the tube 12 and has a length slightly less and no greater than the length of the tube 12. The rope is comprised of plastic such as polyethylene or the like and is impervious to moisture. Rope 22 has an upper end 24, a visible portion 25 (FIG. 2) and a lower end 26. The lower end 26 is affixed to anchor 28 which is crimped at 30 to rigidly affix itself to the lower end 26 of the rope 22. An inverted frusto-conical shaped member 32 is rigidly secured to the lower end of anchor 28 in any convenient fashion. It has an effective diameter greater than that of either the rope 22 or the anchor 28 and serves to resist any upper movement of the rope when deposited in a vertical hole as will be described hereafter.

Figure 1:
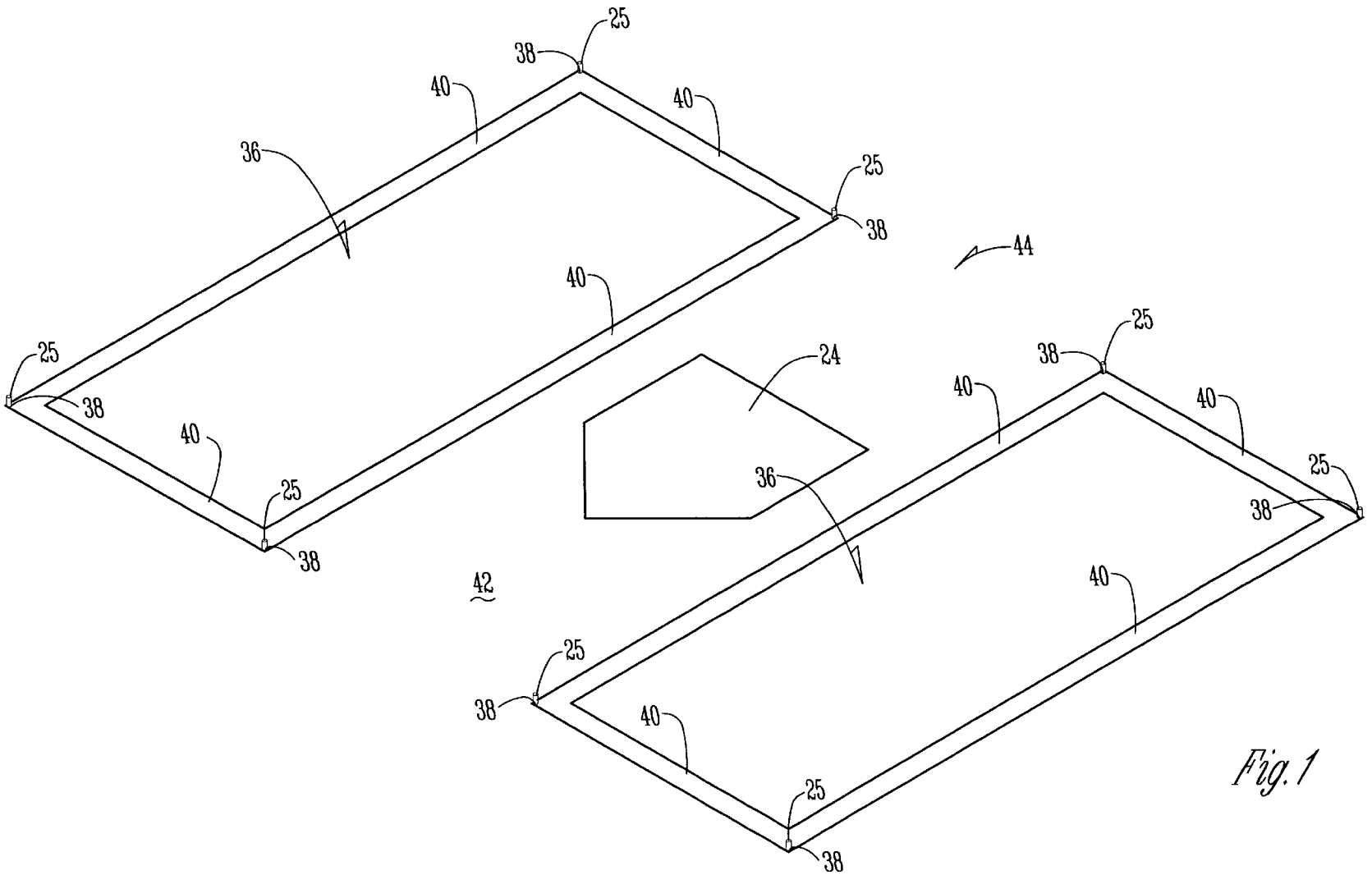
FIG. 1 is a perspective view of the batters' boxes adjacent homeplate for a baseball or softball diamond illustrating the use of this invention.

With reference to FIG. 1, a conventional homeplate 34 is located between conventional batter boxes 36. The batter boxes are determined by perimeter points 38 at the corners thereof and conventional marking lines extend therebetween. The lines are deposited on the ground surface 42 of the earthen athletic field 44 as previously described. As is well known, the lines 40 are obscured during the playing of the game and must be typically replaced between games. To replace the lines 40, the perimeter points 38 either need to be reestablished, or marked in some manner that the lines 40 can be accurately replaced.

Figure 4:
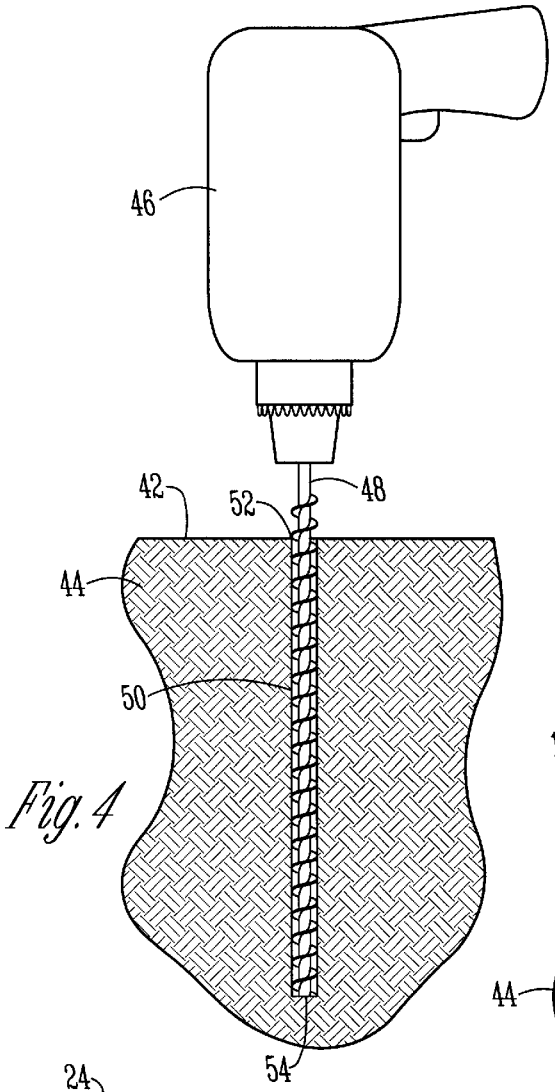
FIG. 4 is a partial sectional view through the ground surface of an athletic field showing how the hole is created for receiving the marking rope.

According to this invention, the perimeter points 38 are permanently located and identified. This is accomplished by taking a conventional drill 46 (FIG. 4) and with bit 50 drilling an elongated vertical hole 50. The hole 50 is substantially equal to the length of tube 12 between the lower end 14 and the stop element 20. The hole 50 has a top end 52 and a bottom end 54.

Figure 5:
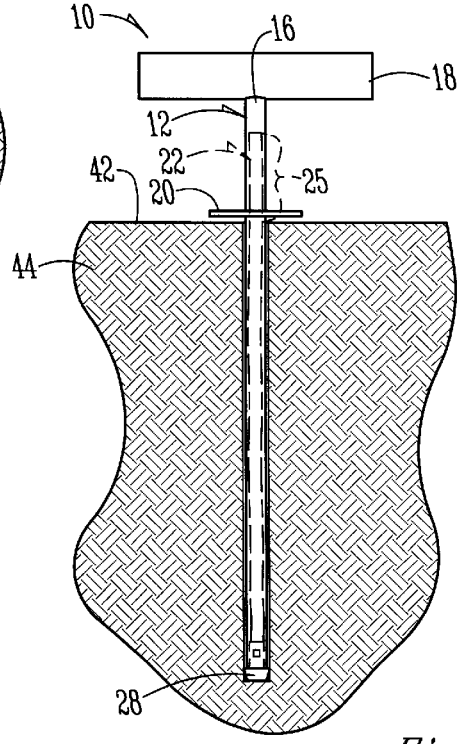
FIG. 5 is a view similar to that of FIG. 4 but shows the insertion tool in place within the hole.
Figure 6:
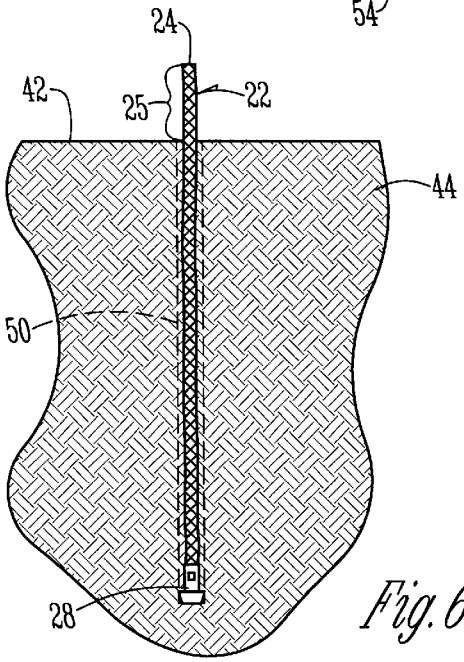
FIG. 6 is a view similar to that of FIG. 5 after the tool has been withdrawn and the marking rope is placed in its operative position.

After the hole 50 has been created, the rope 22 of FIG. 2 has its upper end 24 inserted into the bottom end of tube 12 to assume the position as shown by the dotted lines in FIG. 5. The frusto-conical member 32 prevents the rope 22 from any further upper movement in tube 12 once the member 32 engages the lower end 14 of the tube 12. The "loaded" tool 10 is shown in FIG. 5. The tool should be inserted at a sufficient depth so that the stop element 20 rests adjacent the top of the hole. The tool then is raised vertically to slide upwardly over rope 20 so that the tool is separated from the hole but the rope 22 remains in the hole. Loose dirt or the like is then used to fill in the hole 50 around the rope 22. It should be noted that the visible portion 25 of the rope at its upper end protrudes above the ground surface 42 by reason of its predetermined length in the tube 12 wherein its upper end extends above the stop element 20.

With reference to FIG. 1, the upper visible portion 25 of the ropes 22 protrude above the ground surface at the perimeter points 38. These flexible visible portions 25 of the ropes 22 are essentially permanent and they will not in any way injure the players using the field. The ropes 22 are permanently anchored in the ground by reason of the anchor 28 and the member 32 so that they will not be moved out of position through the use of the field. Since the rope 22 is of plastic and is impervious to moisture, it will not deteriorate by weather conditions or the like.

From the foregoing, it is seen that this invention will achieve at least all of its stated objectives.

What is claimed is:

1. A method of identifying perimeter points for lines on athletic fields through use of single strands of flexible rope at each point, comprising, locating two or more perimeter points on a line of an earthen athletic field comprising a ground surface, drilling a vertical hole in the field at said points, thence placing a flexible elongated single strand of marking rope with a ground anchor on one end longitudinally into each of the holes so that each ground anchor is in the lower end of each hole, and so that an upper portion of each of said ropes extends from each of said holes above the ground surface, and packing loose material in each of the holes around each of the ropes whereupon the upper portions of each of the ropes will serve as a visible indicator of the location of said points.

2. The method of claim 1 wherein each of the ropes is threaded into an elongated tube having a lower end with one of said anchors binding against the lower end, each of said tubes having a length at least equal to the depth of each of said holes, each of said ropes having a length greater than the hole into which it is to be located, pushing the tube downwardly into each of the holes to a depth so that an upper portion of the rope in the tube remains above the ground surface, and removing the tube from the rope.

3. The method of claim 1 wherein a stop element is on each of the tubes adjacent a top end thereof to limit the downward movement of the tubes into the holes to permit the tubes to be inserted into the hole sufficiently to have the upper portions of the ropes above said ground surface.

4. The method of claim 1 wherein a lime material is deposited on the earth between said points.

5. A rope for marking the perimeter points for athletic field lines, comprising, a flexible moisture resistant elongated line having opposite ends, and a diameter, an anchor element on one end of said line and concentrically mounted with respect to the line and having a diameter greater than the diameter of said line.

* * * * *